United States Patent [19]

O'Meara

[11] Patent Number: 4,765,518

[45] Date of Patent: Aug. 23, 1988

[54] UNIT DOSE CONTAINER WITH CAPTIVE CAP

[75] Inventor: John R. O'Meara, Jamesburg, N.J.

[73] Assignee: C P Packaging, Inc., Jamesburg, N.J.

[21] Appl. No.: 69,500

[22] Filed: Jul. 2, 1987

Related U.S. Application Data

[63] Continuation of Ser. No. 870,938, Jun. 5, 1986, abandoned.

[51] Int. Cl.[4] ..... B65D 47/10; B67D 3/00

[52] U.S. Cl. ..... 222/541; 222/543

[58] Field of Search ..... 222/541, 543, 92, 107, 222/106, 562

[56] References Cited

U.S. PATENT DOCUMENTS

| | | | |
|---|---|---|---|
| 2,155,759 | 4/1939 | Hocke | 222/543 |
| 3,777,949 | 12/1973 | Chiquiar-Arias | 222/541 |
| 3,841,537 | 10/1974 | Marg et al. | 222/541 |
| 3,858,739 | 1/1975 | Turner et al. | 222/541 X |
| 4,358,028 | 11/1982 | Chiquiar-Arias | 222/541 X |
| 4,534,483 | 8/1985 | Kassis et al. | 222/543 X |

*Primary Examiner*—H. Grant Skaggs
*Assistant Examiner*—Gregory L. Huson
*Attorney, Agent, or Firm*—Eugene E. Renz, Jr.

[57] ABSTRACT

A container comprises a molded tube having a cap portion attached at one of its ends by a break-away junction and a sealed closure at the other end of its ends. The closure is formed after filling the tube with a unit dose. A cord is attached at one end to the cap by a thickened portion used as an alignment guide when filling and at the other end to the closure, and the cap remains attached to the tube by the cord after breaking the break-away junction.

1 Claim, 4 Drawing Sheets

UNIT DOSE CONTAINER WITH CAPTIVE CAP

This is a continuation of application Ser. No. 870,938 filed June 5, 1986 now abandoned.

FIELD OF THE INVENTION

This invention relates to containers for pharmaceutical products such as vitamins and other products which are supplied in unit dose quantities under hygienically sterile conditions. Oftentimes the unit dose is administered by the patient or by parents and other close relatives in the case of small children.

BACKGROUND OF THE INVENTION

Unit dose quantities of medicines and other materials have been provided in containers which are opened by breaking away a break-away neck which forms an integral part of the cap. One particular design is shown in Turner et al U.S. Pat. No. 3,858,739, which describes a container having a break-away neck portion with an integral cap. The cap has a particularly shaped neck portion designed to keep the user from engaging the container itself during break away. The other end of the cap may be used to close the container after break away.

Similarly, U.S. Pat. No. 3,917,120 to Larenz et al describes single-use containers which are formed of elastic synthetic resin material. These designs include the measuring of a unit dose when a main chamber is squeezed.

Federighi, U.S. Pat. No. 4,512,475 discloses a series of closure assemblies of mini-containers which each contain a single application dose. The containers open at one end and sealed by welding once it is filled. A series of products may be assembled during the molding process so as to connect them through fins which have fracturable score lines to facilitate separation as the individual containers are needed.

Each of these containers is capable of providing a unit dose of a vitamin or other pharmaceutical or medicinal product in a convenient and relatively simply manufactured container.

What is not provided by these prior art designs is a unit dose container which can be easily opened by a person with one hand, such as by a mother holding a young baby, without worrying about what has happened to the cap once the break-away portion has been fractured. None of these prior art designs can be operated with one hand so that the cap does not become separated from the container and become a potential hazard to the infant receiving the medication. This is particularly important when a parent is treating very young infants and where the anxiety of the parent is already elevated because of the need for treatment of the infant. Treatment will be much more effective if the parent can be absolutely certain as to the location of the cap at the time the dose is administered and, even, several hours or longer after administering the dosage.

While it is of primary importance to provide a unit dose container with a cap that is captive to the container, it is also important that the cap be a break-away type molded cap for ease of opening. It is also desirable that the tube be easily filled from the other end, such as prior to forming a sealed closure. It would be ideal if the device could be manufactured from a single molded part and that the closure step after filling would also complete the attachment of the cap.

SUMMARY OF THE INVENTION

It has now been discovered that a unit dose container may be provided with a captive cap. The device includes a molded tube having a cap portion attached at one of its ends by a break-away junction and a sealed closure at the other of its ends, such that the closure is formed after filling the tube with a unit dose. The device further includes a cord attached at one end to the cap and at the other end to the closure. Thus, the cap remained attached to the tube by the cord after breaking the break-away junction. In a preferred embodiment, the tube and cap and cord are all formed in an integrated molded product. When the product is manufactured from a plastic material, as is preferred, the closure may be formed by crimping and heating the closure with the end of the cord being bonded to the closure during the crimping and heating step. It is, of course, preferred during the filling step that a measured unit dose is placed in the tube prior to closure.

The invention further includes a method of making unit dose containers having a captive cap. The method includes the steps of molding a tube having a cap portion attached at one of the tube's ends by a break-away junction, with the cap having a cord attached to the cap at one end and extending with its free end to the open end of the tube. The next step comprises positioning the tube for filling and filling the tube with a unit dose or quantity of the desired product. After filling, a closure is formed on the open end of the tube while at the same time joining the free end of the cord to the tube at the closure. Finally, the container closure is sealed, whereby the cap is attached to the tube after opening the break-away junction.

In a preferred embodiment, the method includes molding the tube to have an open end at one end and a cap portion attached at the other end by a break-away junction and including a cord attached to the cap at one end and extending its free end to the open end of the tube. The method then comprises positioning the tube at a first station to align the tube in a particular direction followed by moving the aligned tube to a second station and filling the tube at that second station. Following the filling step, the filled tube is moved to a third station where the clamping of the open end takes place while simultaneously forcing the free end of the cord into the clamping apparatus so as to form a closure with the free end included. Finally, the clamped tube is moved to a sealing station to seal the open end of the tube and the clamped free end permanently to the closure.

BRIEF DESCRIPTION OF THE DRAWINGS

These and other objects of the present invention and the various features and details of the operation and construction thereof are hereinafter more fully set forth with reference to the accompanying drawings, wherein.

DETAILED DESCRIPTION OF THE PREFERRED EMBODIMENT

Figure 1:
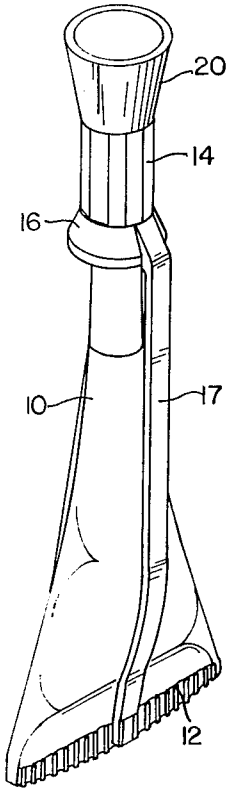
FIG. 1 is an enlarged perspective view of a preferred embodiment of the present invention, illustrating the finished product.

A unit dose container having a captive cap is shown in FIG. 1 as a finished or final product. A tube 10 has a closed end 12 and a top cap 14 which can be broken away to permit access to the contents by pushing on lip 16 and cap 14. Once the cap 14 has separated from the tube 10, it is still tied to the cap via strap or cord 17.

Figure 2:
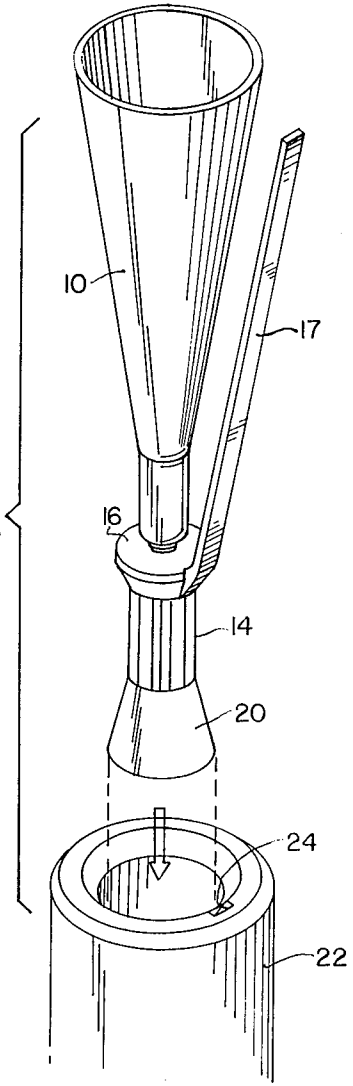
FIG. 2 is an enlarged perspective view of an unfilled or empty molded tube.

In FIG. 2, an empty molded tube is shown having an integrated molded cord 17 which is part of the collar 16 and cap 14. The empty molded tube 10 is being placed within a holding and positioning mandrel 22 so as to position the unit for further operation. Mandrel 22 has slot 24 to accommodate the strap 17 as it is affixed to the collar 16.

Figure 3:
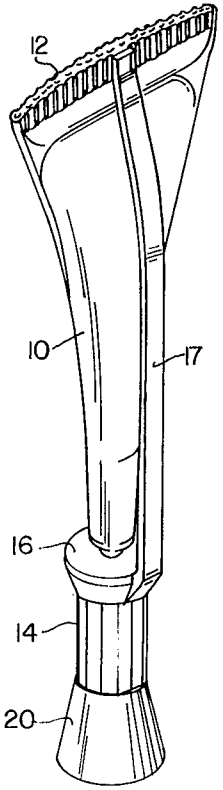
FIG. 3 is an enlarged perspective view of an ejected, filled and finished tube in which the captive cap is attached to the main body of the tube and also is attached by means of the cord to the sealed closure.

FIG. 3 represents the same tube as shown in FIG. 2 after it has completed the manufacturing process and has been filled. Closure 12 has been made as will be described hereinafter from the open end of tube 10 and the free end of strap 17. Thus, strap 17 is fixed to the tube at both the closure end 12 and at the collar 16 of cap 14.

Figure 4:
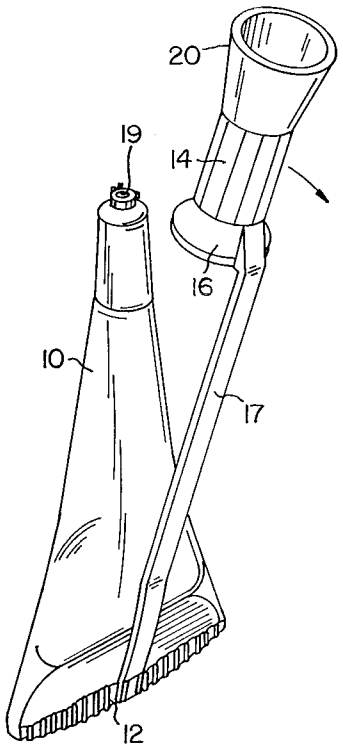
FIG. 4 is an enlarged perspective view of a container showing the cap held captive to the body portion by means of a connecting cord after the cap break-away junction has been broken.

FIG. 4 shows the operation of the break-away feature where pour spout 19 is exposed to permit the contents of tube 10 to be used. Strap 17 is attached at the bottom closure 12 and also affixed to the cap 14 at collar 16. Thus, when the vitamin or other medicine or pharmaceutical product is transferred to the patient, the cap is not lost. Strap 17 prevents the small cap from being lost, such as when a medical person or parent is feeding an infant and it is necessary to hold the infant with one hand and prepare the medicine with only the one free hand. The cap 14 can be snapped off, exposing pour spout 19 without worry as to the possibility that the cap might be lost among the infant's bed clothes or otherwise misplaced. As was mentioned above, when an infant is being fed, oftentimes the attention is directed solely to that event and later anxieties as to the possibility of a cap being accidentally ingested by the infant can be alleviated because the cap is securely attached to the empty container.

Figure 5:
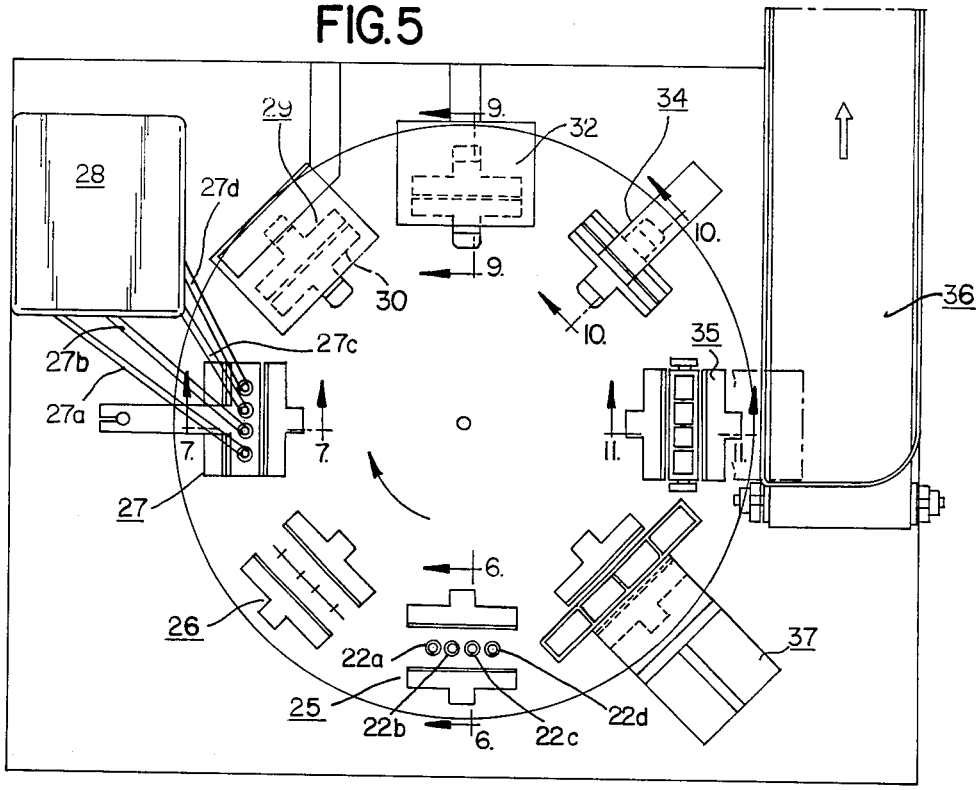
FIG. 5 is a semi-schematic plan view of a machine suitable for making the product of this invention.

FIG. 5 presents in a schematic plan view a machine which is useful in the production of the products of this invention. Located at station 25 is a nest assembly having mandrels 22*a*, 22*b*, 22*c*, 22*d* for holding four tubes for assembly. Station 26 can be used for cleaning or otherwise preparing the tubes prior to filling. Station 27 provides for filling through tubes 27*a*, 27*b*, 27*c*, 27*d* going to fill tubes located on mandrels 22*a*, 22*b*, 22*c*, 22*d*, respectively. Tank 28 contains the material being placed in the tubes, and quantities of the desired ingredient can be metered through lines 27*a*, 27*b*, 27*c*, 27*d* in a conventional manner to provide a unit dose for the various tubes.

Once the tubes have been filled at station 27, they are transferred to station 29 where they are initially clamped using clamp 30. If desirable, an initial preheating step can take place of the clamped portion for each of the tubes held in clamp 30. The device then rotates to the heating station 32 so that at the combined operation of stations 29 and 32, the clamp 30 comes together to push the open end of the tube 10 and the strap 17 together. The preheat and heat station melt all of the portion of the tube above the clamping jaws and thus, at this time, the tube 10 is sealed while simultaneously bonding the strap 17 as it and the tube are melted together.

At station 34, the tube end 10 and the strap 17 are further compressed together during a crimping step so as to make the plastic fully bonded together and making a final seal. Station 35 can be used to eject the product onto the conveyor 36 for packaging. Finally, open station 37 can be provided as an opportunity for extra loading of the tubes 10 into mandrels 22*a*, 22*b*, 22*c*, 22*d*.

Figure 6:
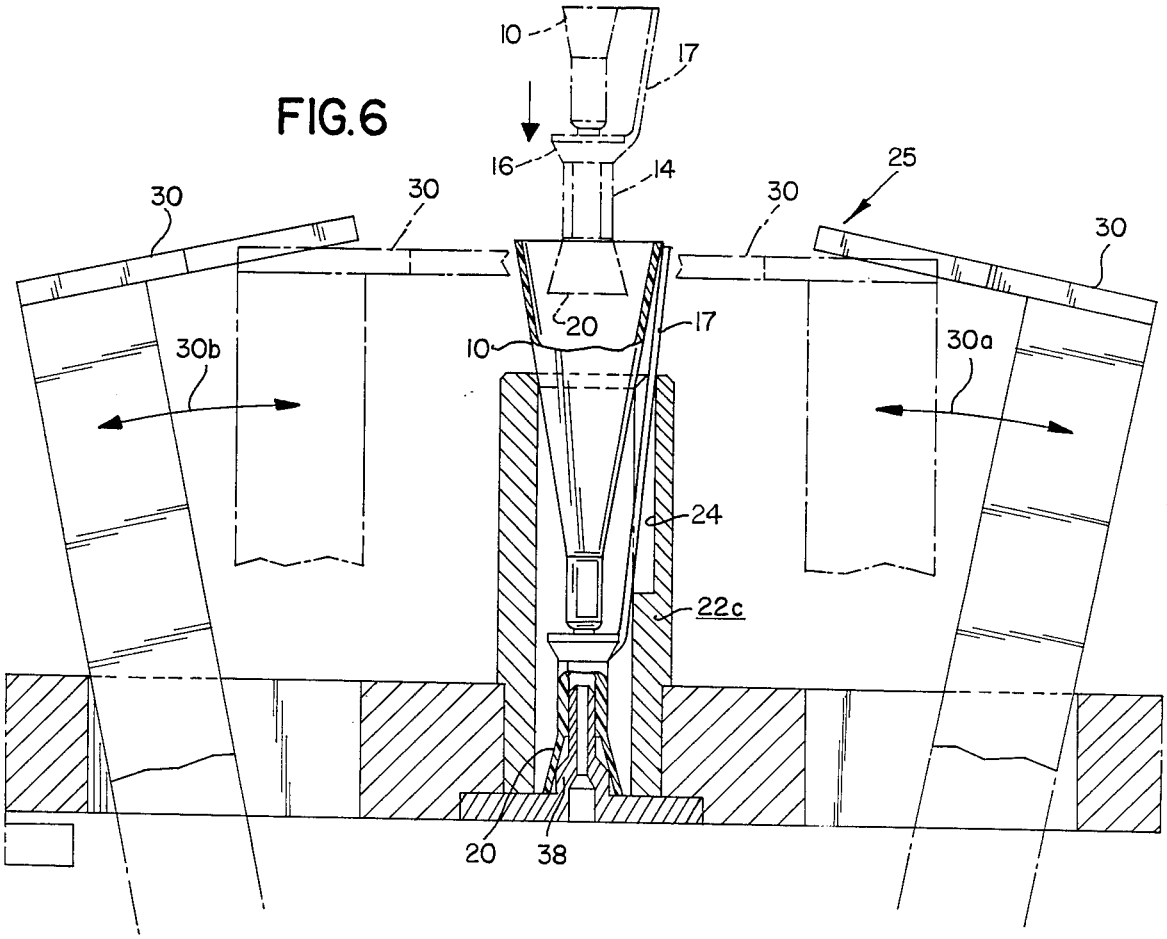
FIG. 6 is an enlarged fragmentary sectional elevational view taken along line 6—6 of FIG. 5.

As shown in FIG. 6, the tube 10 is lowered into the mandrel 22 so that the strap 17 fits into slot 24. The top portion 20 nestles into a holding mandrel 38 as cap 14 is supported at the bottom of mandrel 22. Clamp 30 can be brought into contact with the tube 10 by movement of the clamp in the direction of arrows 30*a* and 30*b*. The amount of movement along arrow 30*a* and 30*b* will govern the amount of pressure that clamp 30 places on the tube 10.

Figure 7:
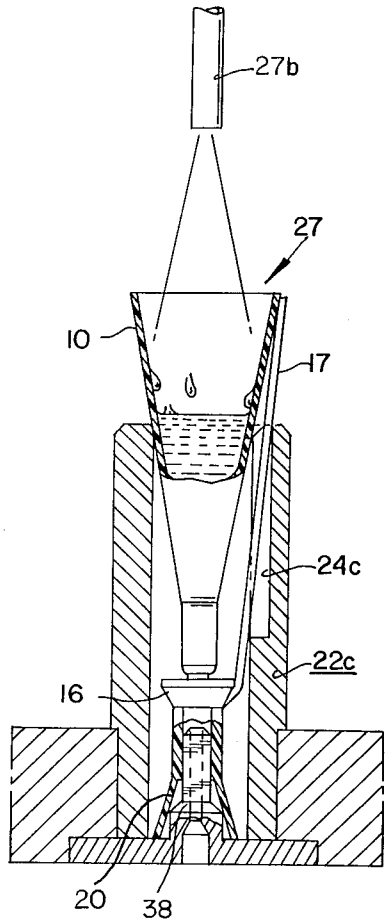
FIG. 7 is an enlarged fragmentary sectional elevational view taken along line 7—7 of FIG. 5.

As shown in FIG. 7, the container is at the volumetric filling station 27, shown along line 7—7 of FIG. 5 while the strap 17 is supported in slot 24*a*. The support from mandrel member 38*a* and mandrel 22*a* with slot 24*a* keeps tube 10 in position to receive the fluid as shown from nozzle 27*a* in FIG. 7.

Figure 8:
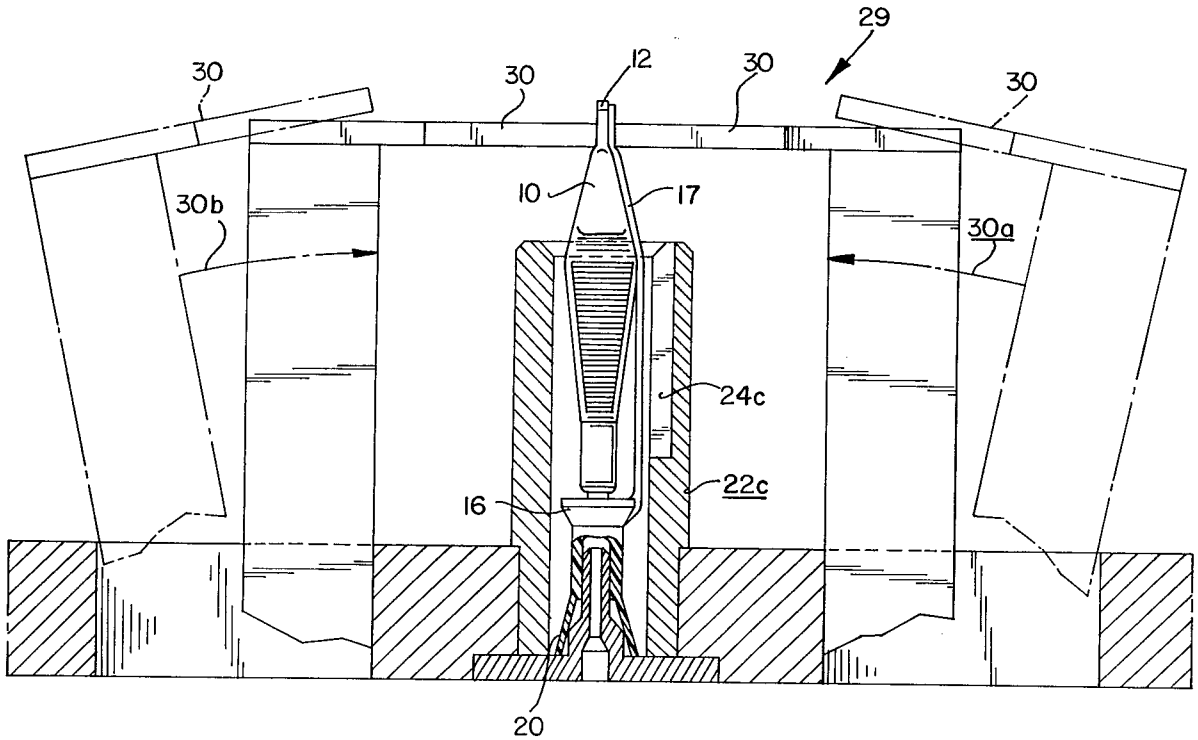
FIG. 8 is an enlarged fragmentary sectional elevational view showing the operation of a closure means.

Once the fluid has been filled, closure is accomplished as shown in FIG. 8. The clamp plates 30 are moved towards each other in the direction of arrows 30*a* and 30*b* so as to form a closed end 12 on tube 10. Strap 17 is compressed along with closed end 12 of tube 10.

Figure 9:
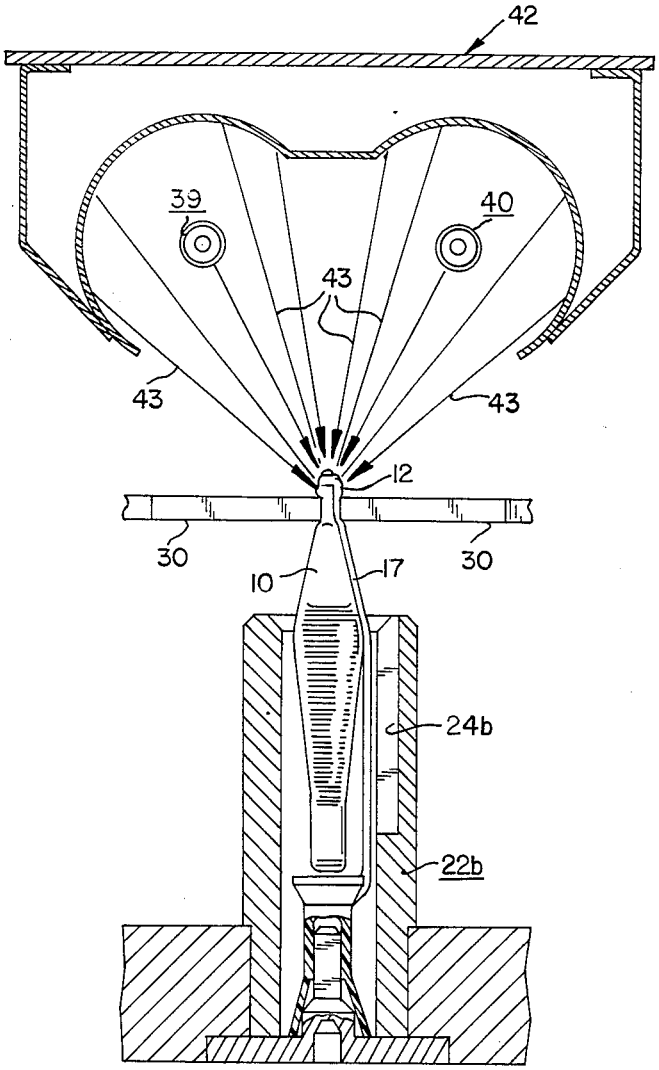
FIG. 9 is an enlarged fragmentary sectional elevational view taken along line 9—9 of FIG. 5.
Figure 10:
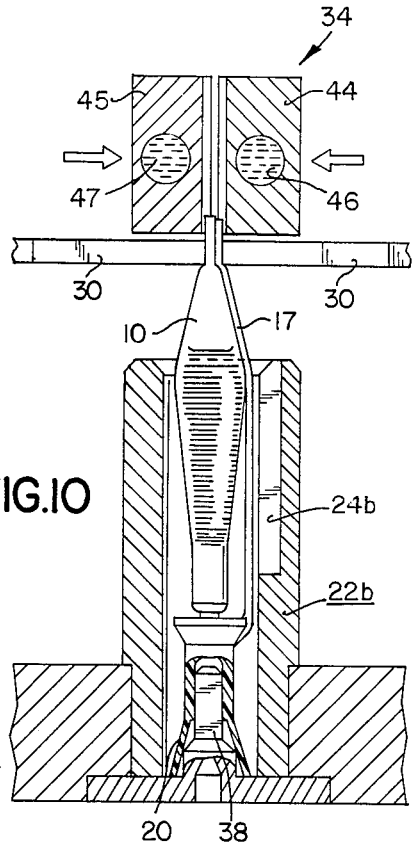
FIG. 10 is an enlarged fragmentary sectional elevational view taken along line 10—10 of FIG. 5.
Figure 11:
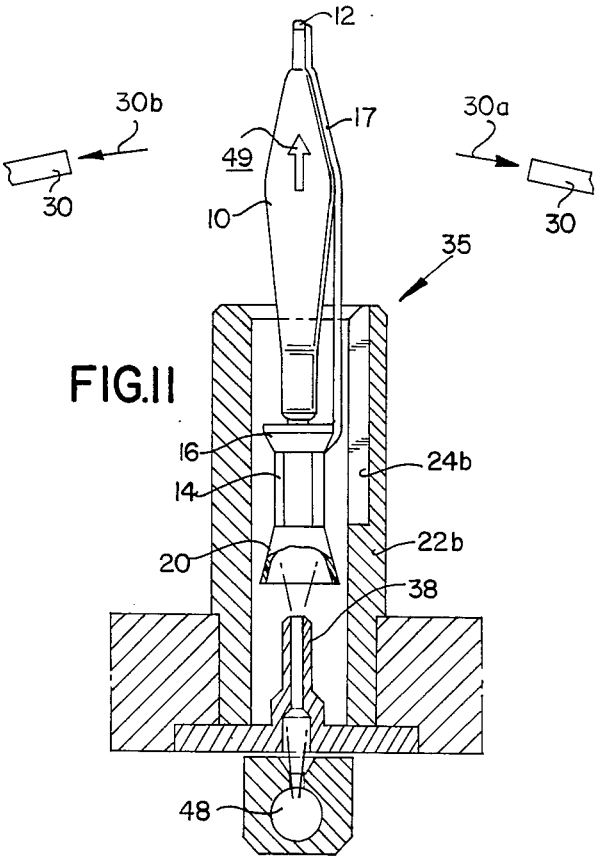
FIG. 11 is an enlarged fragmentary sectional elevational view taken along line 11—11 of FIG. 5.

When the mandrel and tube is rotated to heat station 32, as seen in FIG. 5, strap 17 and closed end 12 are held by clamps 30 as shown in FIG. 9, heat from heaters 39, 40 are directed on plastic 12, 17 so as to form one integral seal. Duct work 42 may be used to focus the heat from heaters 39, 40 in the direction of arrows 43 to melt the plastic end 12. The crimping and cooling step is accomplished as shown in FIG. 10 as the mandrel 22 transfers tube 10 to station 34. Dies 44, 45 are brought to contact the molten plastic 12, 17 above clamp 30 such that a crimping effect is achieved. Dies 44, 45 are cooled by coolant in openings 46, 47 to complete the crimp and form the final seal.

The final ejection of the finished product in ejection station 35. Clamp 30 is opened and a pneumatic means 48 forces the completed package outward from mandrel 22 in the direction shown by arrow 49. Appropriate machinery is positioned to place the finished product on conveyor 36 as shown in FIG. 5.

While a particular embodiment of the invention has been illustrated and described herein, it is not intended to limit the invention and changes and modifications may be made therein within the scope of the following claims.

What is claimed is:

1. A one-piece unit dose container-closure assembly made of a molded plastic material comprising an elongated tubular member having an open end to permit filling, a closure cap integrally connected to the opposite end of said tubular member, a break-away junction between the closure-cap portion and the tubular member, a cord integrally attached to the closure-cap portion and having a thickened portion extending outwardly from said cap in a predetermined orientation with respect to said open end to provide an alignment guide for insertion of said tube into a slotted filling mandrel, said cord extending downwardly from said cap to a point adjacent the lower terminal edge of said tubular member where it is permanently heat sealed at its free terminal end to the lower terminal edge of the tubular member when it is sealed by application of heat and pressure, whereby said cap portion remains attached to said tubular member by said cord upon separation of said closure-cap portion from said tubular member at said break-away junction.

* * * * *